US005083633A

United States Patent [19]

Seeger

[11] Patent Number: 5,083,633

[45] Date of Patent: Jan. 28, 1992

[54] ROPING-DOWN DEVICE

[76] Inventor: Alfred Seeger, Am Steinern Kreuz 45, 6100 Darmstadt, Fed. Rep. of Germany

[21] Appl. No.: 497,415

[22] Filed: Mar. 22, 1990

[30] Foreign Application Priority Data

Jul. 11, 1989 [DE] Fed. Rep. of Germany ..... 3922825

[51] Int. Cl.[5] ..... A62B 1/08

[52] U.S. Cl. ..... 182/233; 182/238; 182/241

[58] Field of Search ..... 182/233, 235, 238, 240, 182/5, 241

[56] References Cited

U.S. PATENT DOCUMENTS

| | | | |
|---|---|---|---|
| 456,282 | 7/1891 | Athey | 182/235 |
| 612,673 | 10/1898 | Naughton | 182/235 |
| 722,648 | 3/1903 | Royse | 182/233 |
| 1,144,702 | 6/1915 | Forest | 182/235 |
| 2,576,755 | 11/1951 | Gaskins | 182/235 |
| 4,523,664 | 6/1985 | Soubry | 182/233 |
| 4,554,997 | 11/1985 | Sheu | 182/233 |
| 4,867,276 | 9/1989 | Tamietti | 182/233 |

FOREIGN PATENT DOCUMENTS

| | | |
|---|---|---|
| 48670 | 9/1889 | Fed. Rep. of Germany . |
| 1110014 | 6/1961 | Fed. Rep. of Germany . |
| 2251462 | 10/1976 | Fed. Rep. of Germany . |
| 2831449 | 7/1978 | Fed. Rep. of Germany . |

*Primary Examiner*—Reinaldo P. Machado
*Attorney, Agent, or Firm*—Michael J. Striker

[57] ABSTRACT

The device for roping down includes a shaft 2 with a central portion which forms a reel 5 for coiling up band rope 6. The two end sections of shaft 2 form brake rotors 9 and 10, which are equipped with wings 11. The wings 11, which rotate during the uncoiling of the band rope operate in brake chambers 31 enclosed by brake housings 12 and 13, these brake chambers being partly or completely filled with sand.

In case of roping down, braking devices 7 and 8 operate automatically and produce a comparatively high braking power which heavily increases as the rate of descending increases. Thus, a constant roping-down rate as a function of the respective load is achieved which rate is used for a safe impact on the ground.

23 Claims, 2 Drawing Sheets

ROPING-DOWN DEVICE

BACKGROUND OF THE INVENTION

The invention relates to a roping-down device including a swivelling reel which is disposed in a housing for winding up a hauling means, an anchoring device and a load suspension device which are attached at the free end of the hauling means and on the housing respectively, and a braking device with a brake rotor, which is connected for operation with the reel, and a brake stator which is mounted on the housing and receives the brake rotor, whereby the braking effect increases as the unwinding and, thus, the rotating rate of the brake rotors increases.

Such a roping-down device with the help of which people may escape from buildings on fire, which, however, may also be used for descending loads, is already known from DE-B 11 10 014. In this document the hauling means is formed by a rope which is wound up on the rope reel in several layers. The swivelling rope reel, which, upon roping down, is rotated by the suspended load, is connected with the shaft of the brake rotor via a chain drive, said brake rotor running separately on bearings and being laterally offset with axle distance from the rope reel in the housing. The brake rotor is provided with associated brake shoes which are guided by journals engaging in grooves and are disposed to be dislocated with respect to the brake rotor so that they are dislocated radially to outside under the influence of the centrifugal force when the brake rotor is rotating and thereby are pressed against the inner circumferential surface of a brake stator ring mounted on the housing which ring encloses the brake rotor only on its outer circumference.

In the case of this roping-down device the anchoring device is secured on the housing and the load suspension device, which has the form of a loop, is attached on the free end of the rope so that the roping-down device itself is not descended and the rope is rewound by means of a flat spiral spring, which is disposed in the device and extends upon roping-down, after the person which has been saved has been freed and/or the load has been taken off on the ground. However, it is also provided within the scope of the invention to exchange the anchoring device and the load suspension device so that the free end of the rope or hauling means is, for instance, anchored on a window cross or otherwise and the roping-down device slides to the ground together with the person and/or the load, as is also already known (DE-A-28 31 449).

The first-mentioned known roping-down device has the advantage that the rope is slowed down automatically and with a braking force which is proportional to the rate of roping down so that a maximum descending rate is achieved which corresponds to the suspended weight and which can be varied by adjusting the dimensions of the roping-down device and, adjusting the dimensions of the braking surfaces, such that there is no risk of incurring injuries even if a heavy person, weighing, for instance, 100 kp, descends. Consequently, a correspondingly softer hitting of the ground is in a desirable manner achieved in the case of the descent of lighter persons (women and children). In particular, it is not necessary that the person which is roped down operates itself the brake or regulates it in order to achieve an individual descending rate, as is the case with the second-mentioned, co-descending roping-down device, which is provided with a crank handle for regulating the effective braking force. We are afraid that in the case of an emergency, and/or in the particular situation in which a building is on fire, mistakes will be made in connection with the operation of the brake even if it is extremely simple to operate, which makes the success of the descent doubtful.

Despite the useful automatic braking effect and the adjustment of the descending rate connected therewith, the known roping-down device described at the beginning cannot fully meet the demands to be made. In particular, operating faults may in the individual case occur as a result of excessive frictional adhesion occurring at the guide journals of the centrifugal shoe brake and/or excessive losses of power in the chain drive between the rope reel and the brake rotor and/or too great adhesive power between adjacent windings of the coiled-up rope so that the rope reel does not start rotating despite the suspended load or the brake does not develop the expected full effect during roping down. Such catastrophic operational faults are favoured by the fact that the roping-down device is normally used only in rare emergencies and after it has been stored for years without its efficiency having been checked. It is obvious that the described danger of failure will be the greater the higher the number of possible sources of fault, which still add to the effect of each other. In this context it must further be pointed out that also excessive abrasion or damage of the brake linings may be the cause for an insufficient braking action and, thus, for a danger for the persons roped down. As far as this is concerned, multiple use of the roping-down device as well as the stress of the brake linings through the braking power which is transformed into heat, affect the functional efficiency. Finally, the known device for roping down includes a great number of component parts, is correspondingly heavy, and is constructed in a less compact way.

It is further known to take in and carry away the kinetic energy to be taken in before persons or loads which are roped down reach the ground (DE-A 48 670). There are provided comparatively large rectangular radial wings which are disposed on the outer side of a wall of a housing and, beside that, act upon the surrounding air without a housing. On the wing tips auxiliary wings which swing out under the influence of the centrifugal power rest on bearings and increase the effective wing surface beyond a predetermined rotating velocity. With the aid of such air wings, which operate substantially without pressure in the open air, only a comparatively weak braking effect can be achieved even if a correspondingly large wing surface is used. Correspondingly, they are used in a device with a rope sheave on which the rope is not wound up, but deflected between its ends which hand down to the ground. On the one end of the rope a cage is suspended, on the other end of the rope a counterweight which is heavier than the cage, so that the latter descends only upon corresponding loading. This means that the described device belongs to a different sort which is heavy and cumbersume and the rope sheave and air vane of which are in operating connection by means of a transmission with four sprockets, whereby a transmission of velocity to the wing shaft takes place in order that the air vanes are braked at all by the air.

SUMMARY OF THE INVENTION

The object of the invention is to design the above described roping-down device such that trouble-free operation and maximum security upon roping down are guaranteed. In addition, the device is to be simple, light and compact and, thus, easy to handle.

According to the invention this problem is solved in that the braking device includes a brake rotor with wings which rotate within a closed brake housing forming the brake stator, said brake housing being filled with a particle material.

Such a braking device can be constructed in an easy manner, since the brake wings operate in the filling of the solid particles and, thus, are effectively slowed down already at a comparatively low rotating velocity. As a consequence thereof the wings may be connected with the reel directly, which means without transmission of the velocity. The particle material may, for instance, be sand with a (mean) granular size of approximately 1 mm. Of course, other granular sizes are possible as well and also other materials may be used, such as steel shot or lead pellets. The rotating wings thereby have a pump-like effect on the material filling, whereby energy-consuming effects occur and cause the braking action. In this connection one can distinguish between a centrifugal effect, which causes the particles to be pressed against the circumferential wall of the housing and/or against a layer which adheres to said wall, and a whirling effect, which is the reason for the particles to circulate with a certain conveying effect, whereby the particles are accelerated within the range of influence of the wings and are returned and slowed down outside this range of influence. Both effects are influenced also by the specific weight of the filling material which, for a better braking effect, should rather be higher than lower. Another energy-consuming effect is the friction between the moved particles, whereby part of the rotational energy which is to be slowed down can be diverted into abrasion work. Another part of the rotational energy is diverted into heat upon braking. By means of an appropriate choice and quantity of the particle material one is in a position to provide for a sufficient heat capacity of the filling, so that no separate measures for the carrying-off of heat and/or for cooling are required and, instead of that, the braking device may possibly even be provided with a heat insulation, e.g. of fire-proof felt, which serves as a shield against hot parts.

Apart from the number, shape and size of the wings as well as their distance from the walls of the housing and the characteristics of the particle material, such as size, specific weight, and surface quality, the braking effect may further be influenced in a very simple manner by the degree of filling of the brake housing chamber. It is apparent that the braking action increases as the degree of filling increases. Correspondingly, the permitted maximum descending rate which guarantees an unrisky impact on the ground, can be adjusted very easily. As a standard value a descending rate of 1 m/s in the case of a load of 100 kp can be given, which corresponds to a heavy person.

Another advantage of the invention is that no expensive sealing means are required between the housing of the brake and the wing shaft or wing centre and that, consequently, no operating faults because of defective sealing means can occur, either. Between the rotating particles and the brake housing there may be provided apertures of a size which is too small for the particles to pass out. Apart from that, limited losses of filling material and the passing out of fine rubbed-off parts do not essentially affect the braking action. An abrasive, possibly unfavourable effect due to sand in the area of the bearing apertures can be prevented by using oil-drenched sand.

Thus, the roping-down device of the invention meets all above mentioned requirements without demanding a costly construction which would make the device expensive and unwieldy.

The present invention both as to its construction so to its method of operation, together with additional objects and advantages thereof, will be best understood from the following detailed description of specific embodiments when read in connection with the accompanying drawings.

DETAILED DESCRIPTION OF THE PREFERRED EMBODIMENTS

Figure 1:
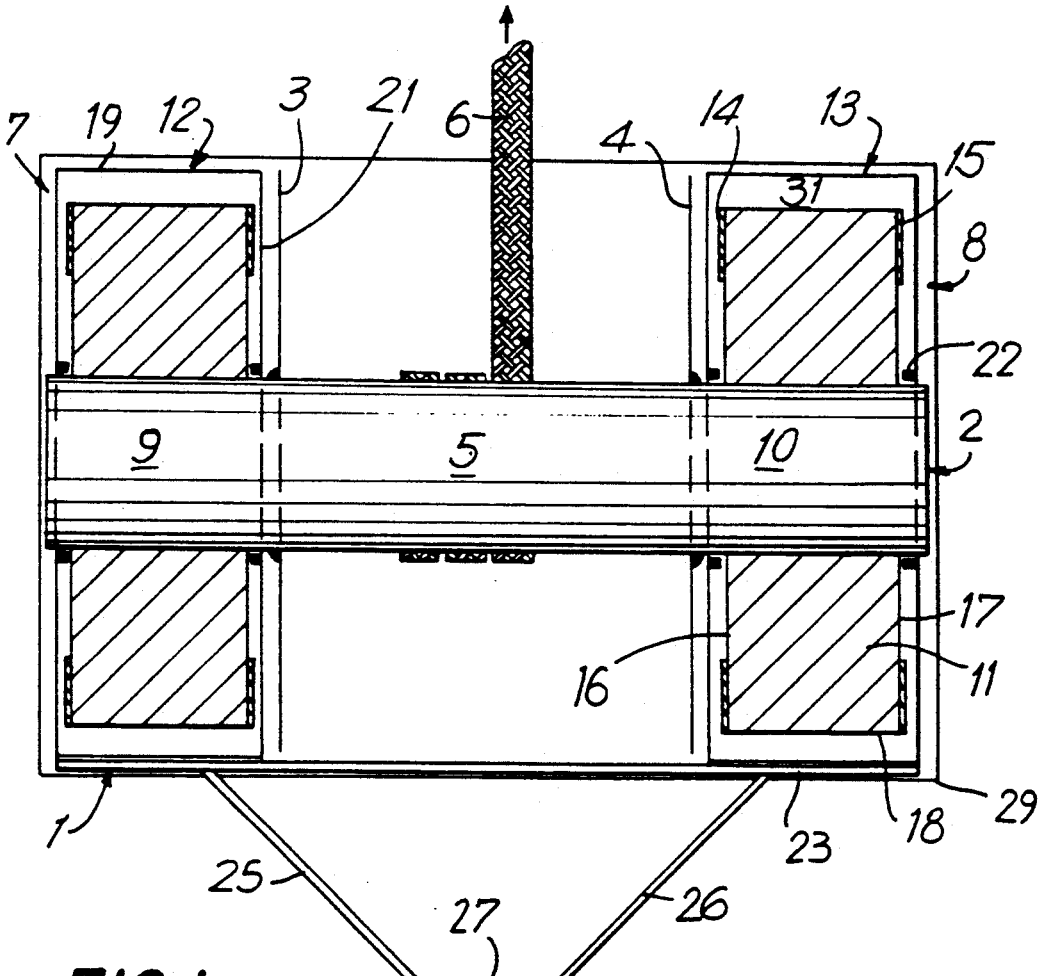
FIG. 1 is a vertical axial section of a first roping-down device.

The device according to FIG. 1 contains a bearing part or housing 1 and a shaft 2 which may be adjusted with respect to the housing. Two side rings 3 and 4, extending in two radial planes, are welded to the shaft and define a central shaft portion which forms a reel 5 for winding up a band-shaped hauling means 6 secured to it. FIG. 1 shows the hauling means 6 and/or the band at a point where it is already almost completely unwound. The flat, braided band can be coiled up on the reel 5 in several layers, thereby filling the space between side rings 3 and 4, without the band getting jammed and, thus, causing problems upon unreeling.

On either end of shaft 2 there is a braking device 7, 8. The latter consists of a brake rotor 9/10 formed by the respective end portion of shaft 2, either rotor containing six wings 11 and a brake housing 12/13 which surrounds the wings 11. As can be seen from FIG. 1, the two braking devices 7 and 8 are designed identically and symmetrically with respect to the radial central plane of the roping-down device.

The six wings of either braking device are mounted on the one-piece shaft 2 with equal angles, e.g. they may be welded to said shaft. The wings 11 are shown as radially extending rectangular or square wings. However, also other wing shapes and deviations from the radial extension are possible. For example, the wings may be bent in the form of a shovel and they may with their inner edge also be adjacent to shaft 2 under an inclination towards the axis of shaft 2, the wings 11 preferably being placed alternately with equal inclination in opposite directions. In their respective inner radial sector the wings 11 are connected with each other by two reinforcing rings 14 and 15 at the sides and are thereby stabilized. The radial width of these reinforcing rings may be between half and a third of the radial length of the lateral edges 16 and 17 of the wings 11. The reinforcing rings 14 and 15 at the sides thereby extend to the outer edge 18 of the wings 11.

The two brake housings 12 and 13 essentially form the bearing part or housing 1. Either housing consists of a circumferential surface 19, which is radially spaced opposite the outer edges 18 of the wings 11, and of two annular facings 20 and 21 which are axially spaced opposite the lateral edges 16 and 17 respectively. The facings 20 and 21 at their outer circumference verge into circumferential surface 19 and with their inner circumference are slipped on shaft 2 and/or the brake rotors 9 and 10. On their inner circumference, either of the facings 20 and 21 has a ring flange 22 projecting to the wings 11 which flange substantially bridges the axial distance from the wings and which leaves only a narrow running groove. The two brake housings 12 and 13 on shaft 2 are secured in their position by a connecting rod 23 with a diameter of e.g. 10 mm which forms part of housing 1 which, on the lower side, touches the outer side of the circumferential surface 19 of the two brake housings 12 and 13 and which is rigidly connected with said housing e.g. by welding. Also on the upper side of the housings 12 and 13 there may be provided a band-iron fixed link (not shown) which corresponds to connecting rod 23. In this case it is useful to laterally offset this link by half of the diameter of shaft 2 and to provide it with a longitudinal groove which serves to guide hauling means 6 which passes through, but which, however, does not extend over the whole axial length of reel 5, but should only be approximately half as long so that, upon unwinding of hauling means 6, the roping-down device inclines less with respect to the horizontal central position shown in FIG. 1 than corresponds to the given winding width.

At the unwound upper end of the band-shaped hauling means 6, which is not visible in FIG. 1, there is provided an anchoring device (not shown) which renders possible that the device is secured, for instance, in the roof or window area of multistorey buildings, on towers, bridges or also on helicopters. On housing 1 a load suspension device 24 is shown which is linked to the connecting rod 23 in the form of a weldment and includes two bearing rods 25 and 26 which are inclined in opposite directions, a reinforcement 27, and an eye hook 28 in the radial central plane. FIG. 1 in reduced scale indicates a person which is suspended on the eye hook by means of a belt in order to be roped down.

A protecting tube 29 of fire-proof synthetic material encloses the roping-down device with the exception of the anchoring means (not shown) and the load suspension device 24. The protecting tube 29 is provided with an axial groove 30 through which the band-shaped hauling means 6 is guided.

Each brake chamber 31 defined in brake housings 12 and 13, which receives the wings 11 of the respective brake rotor 9 or 10 is, in a manner not shown, partly or completely filled with a granular material such as silica sand which was drenched with oil—in the case of the tested device approximately 10% by volume oil in the sand. The granular material may occupy from about 75% to 100% of the free volume of the brake chamber 31.

In the case of the tested embodiment a hollow rope braided of poly-p-phenylene-terephtalamite (PPD-D) filament was used. This synthetic material has a tensile strength which is approximately five times as high as that of steel and it keeps its characteristic features up to approx. 200° C. The band-shaped hollow rope has profile dimensions of 12×2 mm. The length of the coiled-up rope may, for instance, be 25 or 50 or 100 m and more. The device may, for example, be welded together of sheet steel or aluminium sheets with a thickness of 1 mm and 2 mm respectively. The shaft is designed as sleeve shaft so that hauling means 6 can simply be passed through an aperture in the side of shaft 2 with one of its ends and may be secured on the shaft by a knot. In addition to that, the hollow shaft can be designed with a sufficiently large diameter without excessive increase of weight so as to avoid extreme bends of hauling means 6 which is made of the comparatively brittle synthetic filaments.

Good results have been achieved with a roping-down device in which the axial distance between the lateral edges 16 and 17 of the wings 11 and the facings 20 and 21 of the brake housings 12 and 13 is 5 mm and the radial distance between the outer edges 18 of the wings 11 and the circumferential surface 19 of the brake housings 12 and 13 is 10 mm, while the brake housings 12 and 13 have an axial width of 60 mm and an outer diameter of 170 mm as well as an inner diameter of 50 mm, which corresponds to the diameter of shaft 2. The axial width of reel 5 with side rings 3 and 48 which is positioned in between, is approximately 120 mm. This means a length of 250 mm and a diameter of 172 mm for the protecting tube.

It has been observed in tests with the above described device that excessive heating is avoided by means of the capacity for taking in the energy produced in roping-down, which capacity is available because of the oil-drenched sand filling and the metal construction. A medium increase of temperature of only about 2° K. per 100 kp roping-down load and 10 m roping-down height has been calculated. Correspondingly, roping-down from a height of 100 m and more is no problem with respect to the heating, because the device may be provided with a protecting heat insulation.

As has already been mentioned, the energy produced in roping-down as a consequence of centrifugal friction forces and non-centrifugal friction forces (sand circulation) is taken into the braking device. The non-centrifugal friction forces may be augmented by using less oil and/or more sand in brake housings 12 and 13 as well as by reducing the number of the wings 11 and/or their distance from the walls of the brake housings. The centrifugal friction force may in this case be smaller, which allows a smaller diameter of the brake housing and, thus, a roping-down device of especially practical dimensions, which, however, has the same efficiency. Instead of doing so, it is certainly also possible to increase the load which may be roped down without rising of the roping-down velocity.

Figure 2:
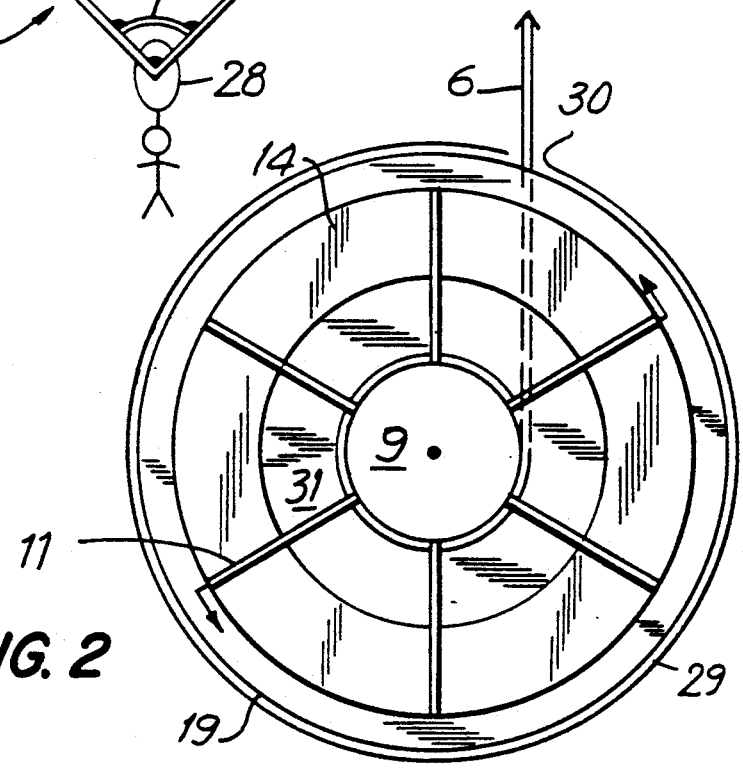
FIG. 2 is a radial section in the brake housing sector of the roping-down device according to FIG. 1.
Figure 3:
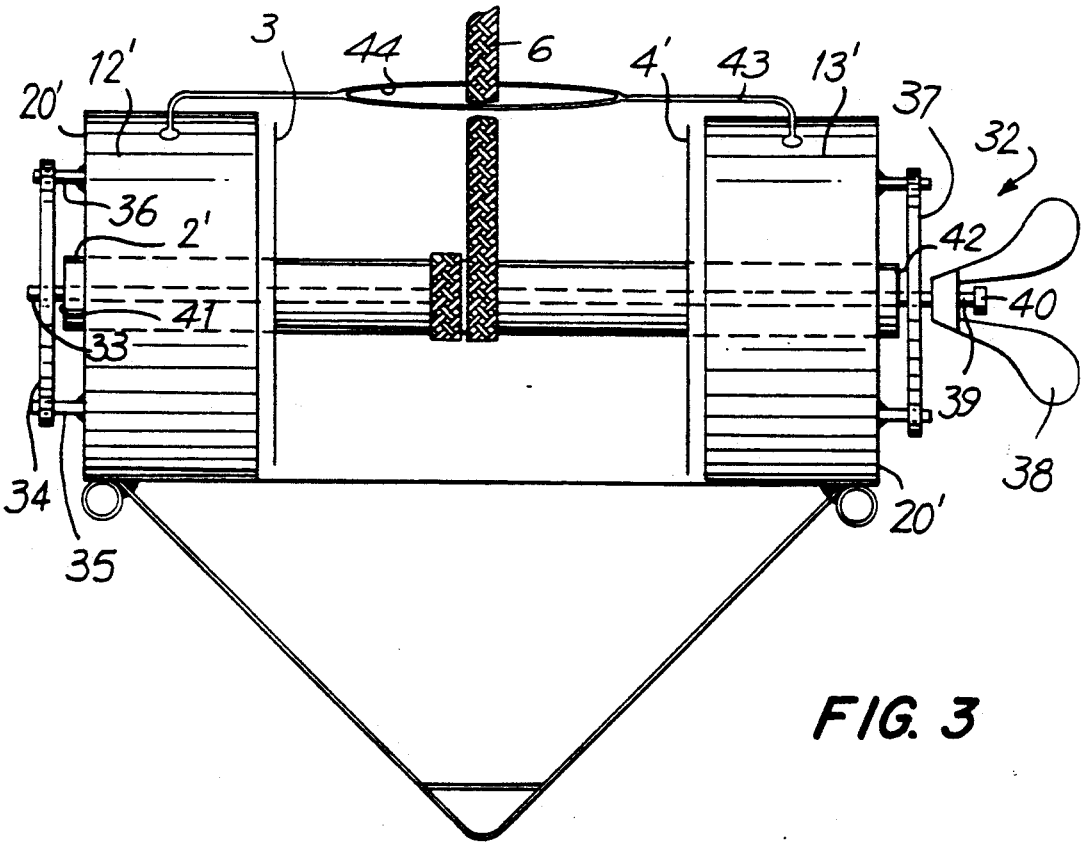
FIG. 3 is a front view of the second roping-down device.
Figure 4:
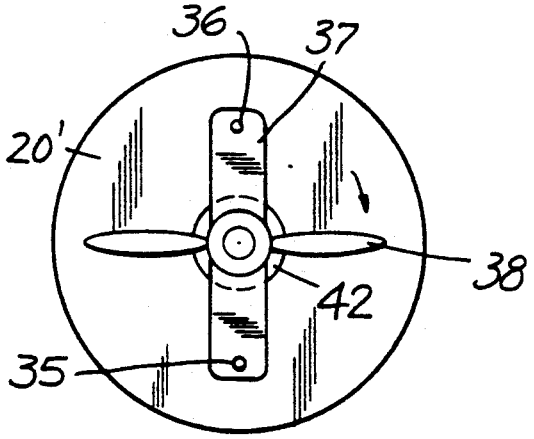
FIG. 4 is a partial end view of the roping-down device according to FIG. 3.

According to FIGS. 3 and 4 a roping-down device is provided which is designed and which operates in a way corresponding to the above described roping-down device of FIGS. 1 and 2. For this reason corresponding parts are designated with the same reference numbers, distinguished only by an apostrophe which is added to the respective number, and these parts are not described again. The special feature of the device as shown in FIGS. 3 and 4 is that there is provided a manual brake 32 in addition to the automatically operating braking devices in the brake housings 12' and 13'.

The hand brake 32 includes a brake bar 33 extending through the hollow shaft 2' which, on either side, projects slightly with respect to the brake housings 12' and 13'. On the end of the bar, which projects with respect to shaft 2' and is positioned on the left-hand side in FIG. 3, a brake plate 34 is attached and is either rigidly connected with brake bar 33 by welding or held on brake bar 33 by means of a bar flange. The brake plate 34 is designed as a long plate with a width which corresponds approximately to the outer diameter of shaft 2' and is on either end provided with a bore by which it is guided unto guide journals 35 and/or 36 which project axially from the outer facing 20' of brake housing 12'.

Also on the right end of the bar there is a corresponding brake plate 37, which is attached such that it may slide, said brake plate being guided by two guide journals in an appropriate manner and being supported at its outer side by means of a wing nut 38 which is srewed unto a threaded section 39 of brake bar 33 and is protected against loss by means of a cap 40.

As can easily be seen, the brake plates 34 and 37, which, on their inner sides, can be provided with a brake lining, may be engaged or disengaged with the braking surfaces 41 and 42 which are defined by the facings of sleeve shaft 2' by tightening or loosening wing nut 38. The manual brake 32 allows not only an individual reduction of the roping-down velocity which develops as a consequence of the automatically operating braking devices, but, which is more, the person roped down can at any time cause an intermediate stop by srewing up the wing nut and can continue roping down after that. Thus, this device is suited also for working at normally inaccessible fronts of buildings, for mountaineering and for other cases in which similar requirements are made.

FIG. 3 indicates also an upper connection 43 between the brake housings 12' and 13', which is laterally offset by half of the diameter of shaft 2' and is provided with a running groove 44 for the guide of hauling means 6' the length of which is smaller than the distance between the two side rings 3' and 4' of the reel.

While the invention has been illustrated and described as embodied in specific embodiments of a roping-down device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A roping-down device comprising a housing; hauling means; a swivelling reel located in said housing for winding up said hauling means; load suspension means attached to said housing; and braking means associated with said swivelling reel for automatically braking said swivelling means in accordance with unwinding of said hauling means, said braking means including a brake housing mounted in said housing of said roping-down device, a brake rotor having a plurality of wings, located in said brake housing, and connected with said swivelling reel for joint rotation therewith, and a particle material filling said brake housing.

2. A roping-down device as set forth in claim 1, wherein said brake housing has two opposite facings and a circumferential surface connecting said two opposite facings, each of said plurality of wings being formed as a substantially rectangular radial wing having two opposite lateral edges facing said two opposite facings of said brake housing, respectively, and an outer edge connecting said two opposite lateral edges and arranged opposite said circumferential edge of said brake housing.

3. A roping-down device as set forth in claim 2, wherein said brake rotor includes reinforcing rings connecting said plurality of wings.

4. A roping-down device as set forth in claim 2, further comprising a shaft located in said housing of said roping-down device for supporting said swivelling reel, said opposite facings of said brake housing being planar annular surfaces arranged with a bearing clearance about one of an extension of said shaft and said swivelling reel.

5. A roping-down device as set forth in claim 2, wherein each of said two opposite facings of said brake housing has an inner circumferential end surface, and an annular flange extending axially from said inner circumferential end surface and having an end surface spaced from respective lateral edges of said plurality of wings by a clearance distance.

6. A roping-down device as set forth in claim 1, further comprising a shaft located in said housing of said roping-down device for supporting said swivelling reel, said braking means including another brake housing filled with the particle material and another brake rotor having a plurality of wings, located in said another brake housing, and connected with said swivelling reel for joint rotation therewith, said brake rotor and said another brake rotor being formed by one of opposite ends of said swivelling reel and opposite extensions of said shaft.

7. A roping-down device as set forth in claim 1, wherein said particle material fills from about 75% to 100% of an internal free volume of said brake housing.

8. A roping-down device as set forth in claim 1, wherein said particle material is a granular material.

9. A roping-down device as set forth in claim 8, wherein said granular material is sand.

10. A roping-down device as set forth in claim 8, wherein said granular material comprises oil-drenched silica sand.

11. A roping-down device as set forth in claim 1, wherein said hauling means comprises a braided hollow rope of synthetic filament with high tensile strength and a band-like profile.

12. A roping-down device as set forth in claim 1 further comprising a manual brake operable until standstill when a load is suspended.

13. A roping-down device as set forth in claim 1, further comprising a hollow shaft having opposite end facing and located in said housing for supporting said swivelling reel, said manual brake including a brake rod extending through said hollow shaft and having opposite end portions projecting from opposite sides of said hollow shaft, one of said opposite end portions having a threaded section; two brake plates mounted on said opposite end portions of said brake rod, respectively; and a nut screwable onto said threaded section; said opposite sides of said hollow shaft defining opposite braking surfaces, said two brake plates frictionally engaging said opposite braking surfaces, respectively, upon tightening of said nut.

14. A roping-down device comprising a housing; hauling means; a swiveling reel located in said housing for winding up said hauling means; load suspension means attached to said housing; and braking means associated with said swivelling reel for automatically braking said swivelling means in accordance with unwinding of said hauling means, said braking means including a brake housing mounted in said housing of said roping-down device, a brake rotor having a plurality of wings, located in said brake housing, and connected with said swivelling reel for joint rotation therewith, and a granular material filling said brake housing.

15. A roping-down device as set forth in claim 14, wherein said granular material fills from about 75% to about 100% of an internal free volume of said brake housing.

16. A roping-down device as set forth in claim 14, wherein said granular material consists essentially of sand.

17. A roping-down device as set forth in claim 14, wherein said granular material consists essentially of oil-drenched silica sand.

18. A roping-down device as set forth in claim 14, wherein said hauling means comprises a braided hollow rope of synthetic filament with high tensile strength and a band-like profile.

19. A roping-down device as set forth in claim 14, further comprising a hollow shaft having opposite end facing and located in said housing for supporting said swivelling reel and a manual brake operable until standstill, when a load is suspended, said manual brake including a brake rod extending through said hollow shaft and having opposite end portions projecting from opposite sides of said hollow shaft, one of said opposite end portions having a threaded section; two brake plates mounted on said opposite end portions of said brake rod, respectively; and a nut screwable onto said threaded section; said opposite sides of said hollow shaft defining opposite braking surfaces, said two brake plates frictionally engaging said opposite braking surfaces, respectively, upon tightening of said nut.

20. A roping-down device as set forth in claim 14, further comprising a shaft located in said housing of said roping-down device for supporting said swivelling reel, said braking means including another brake housing filled with the granular material and another brake rotor having a plurality of wings, located in said another brake housing, and connected with said swivelling reel for joint rotation therewith, said brake rotor and said another brake rotor being formed by one of opposite ends of said swivelling reel and opposite extensions of said shaft.

21. A roping-down device comprising a housing; hauling means; a swiveling reel located in said housing for winding up said hauling means; load suspension means attached to said housing; and braking means associated with said swivelling reel for automatically braking said swivelling means in accordance with unwinding of said hauling means, said braking means including a brake housing mounted in said housing of said roping-down device, a brake rotor having a plurality of wings, located in said brake housing, and connected with said swivelling reel for joint rotation therewith, and a granular material filling said brake housing, said brake housing having two opposite facings and a circumferential surface connecting said two opposite facings, each of said plurality of wings being formed as a substantially rectangular radial wing having two opposite lateral edges facing said two opposite facings of said brake housing, respectively, and an outer edge connecting said two opposite lateral edges and arranged opposite said circumferential edge of said brake housing, said brake rotor having reinforcing rings connected to the two opposite lateral edges of the wings.

22. A roping-down device as set forth in claim 21, further comprising a shaft located in said housing of said roping-down device for supporting said swivelling reel, said opposite facings of said brake housing being planar annular surfaces arranged with a bearing clearance about one of an extension of said shaft and said swivelling reel.

23. A roping-down device as set forth in claim 21, wherein each of said two opposite facings of said brake housing has an inner circumferential end surface, and an annular flange extending axially from said inner circumferential end surface and having an end surface spaced from respective lateral edges of said plurality of wings by a clearance distance.

* * * * *